US008296971B2

(12) United States Patent
Majak

(10) Patent No.: US 8,296,971 B2
(45) Date of Patent: Oct. 30, 2012

(54) DEVICE FOR RELIEVING PRESSURE FROM A SELECTED AREA OF AN ANIMAL'S SKIN AND METHODS OF FABRICATING AND APPLYING THE SAME

(76) Inventor: Walter H. Majak, Watertown, NY (US)

( * ) Notice: Subject to any disclaimer, the term of this patent is extended or adjusted under 35 U.S.C. 154(b) by 467 days.

(21) Appl. No.: 12/686,898

(22) Filed: Jan. 13, 2010

(65) Prior Publication Data

US 2011/0167673 A1 Jul. 14, 2011

(51) Int. Cl.
*A43B 13/38* (2006.01)

(52) U.S. Cl. ..... 36/88; 36/43; 36/29

(58) Field of Classification Search ..... 36/88, 93, 36/43, 44, 29
See application file for complete search history.

(56) References Cited

U.S. PATENT DOCUMENTS

| | | | | | |
|---|---|---|---|---|---|
| 2,090,881 | A * | 8/1937 | Wilson | 36/29 |
| 2,189,813 | A * | 2/1940 | McGuire | 428/166 |
| 2,739,093 | A * | 3/1956 | Bull | 156/79 |
| 3,589,037 | A * | 6/1971 | Gallagher | 36/44 |
| 4,112,599 | A * | 9/1978 | Krippelz | 36/11.5 |
| 4,356,642 | A | 11/1982 | Herman | |
| 4,633,877 | A * | 1/1987 | Pendergast | 36/140 |
| 4,999,931 | A * | 3/1991 | Vermeulen | 36/29 |
| 5,154,682 | A * | 10/1992 | Kellerman | 36/44 |
| 5,201,125 | A * | 4/1993 | Shorten | 36/29 |
| 5,282,288 | A | 2/1994 | Henson | |
| 5,329,705 | A * | 7/1994 | Grim et al. | 36/88 |
| 5,438,768 | A * | 8/1995 | Bauerfeind | 36/44 |
| 5,564,202 | A * | 10/1996 | Hoppenstein | 36/25 R |
| 5,753,061 | A * | 5/1998 | Rudy | 156/147 |
| 5,761,834 | A | 6/1998 | Grim et al. | |
| 5,768,803 | A * | 6/1998 | Levy | 36/43 |
| 5,830,553 | A * | 11/1998 | Huang | 428/72 |
| 6,006,448 | A * | 12/1999 | Hellman | 36/11.5 |
| 6,412,194 | B1 * | 7/2002 | Carlson et al. | 36/43 |
| 6,519,797 | B1 * | 2/2003 | Brubaker et al. | 5/654 |
| 6,618,959 | B1 * | 9/2003 | Sussmann | 36/29 |
| 6,792,699 | B2 | 9/2004 | Long et al. | |
| 6,872,270 | B2 | 3/2005 | Cho et al. | |
| 7,153,560 | B2 * | 12/2006 | Hofmann | 428/178 |
| 7,448,150 | B1 | 11/2008 | Davis et al. | |
| 7,475,497 | B2 * | 1/2009 | Hoffer et al. | 36/28 |
| 7,506,543 | B2 | 3/2009 | Chiodo et al. | |
| 2005/0155255 | A1 * | 7/2005 | Wilson et al. | 36/29 |
| 2006/0174515 | A1 | 8/2006 | Wilkinson | |
| 2006/0196260 | A1 | 9/2006 | Khajavi | |

OTHER PUBLICATIONS

The inventor is also aware of a prior art Darco peg assist device in which hexagonal pegs may be selectively removed from a foot support. The Examiner is encouraged to review these types of devices made by Darco at www.darcointernational.com, At least some of the Darco devices are provided with a marking tube to mark the area of desired pressure reduction and to ensure proper peg removal.

* cited by examiner

*Primary Examiner* — Marie Patterson

(57) ABSTRACT

A sheet adapted for juxtaposition adjacent to a region of an animal, such as a human foot, for relieving pressure at a selected sub-region such as a particular part of a foot sole or a foot heel. The sheet possesses an upper surface and a lower surface substantially coplanar with the upper surface. An array of sealed cells are filled with a flowable substance. Selected cells may be punctured such that they collapse in the region to be disposed next to a sore area. The healthy region around the sore area absorbs any pressure, and pressure is relieved from the sore area. Methods of creating the sheet and methods of utilizing the sheet are also disclosed.

23 Claims, 3 Drawing Sheets

DEVICE FOR RELIEVING PRESSURE FROM A SELECTED AREA OF AN ANIMAL'S SKIN AND METHODS OF FABRICATING AND APPLYING THE SAME

FIELD OF THE INVENTION

The present invention relates to a device for relieving pressure on a selected area of an animal's skin, especially a human's skin, and especially areas on a person's foot. Methods of fabricating the device and methods of applying the device are also disclosed.

BACKGROUND OF THE INVENTION

Animals such as humans often suffer pain from various sore-like conditions that affect a region near their skin. Such sore-like conditions include blisters, ulcers, calluses, corns, arthritis, and boney prominences. These conditions are especially painful when they are located in a weight-bearing region of the animal, such as a foot, ankle, knee, elbow, or hip. Of increasing concern in connection with humans is the generation of foot ulcers that are associated with diabetes or that occur with immobilization subsequent to surgery such as hip replacement surgery.

The medical industry seeks remedies not only to reduce or eliminate pain associated with sore-like conditions, but also to prevent such conditions from becoming exacerbated, to promote healing of such conditions, and to prevent the recurrence of such conditions. Remedies would enhance the health and well-being of patients, while reducing visits to health care practitioners, in-hospital stays, and medical expenses.

SUMMARY OF THE INVENTION

The present invention relates to a sheet adapted for juxtaposition adjacent to a region of an animal, such as a human foot, for relieving pressure at a selected sub-region such as a particular part of a foot sole or a foot heel. The sheet possesses an upper surface and a lower surface substantially coplanar with the upper surface. An array of scaled cells are filled with a flowable substance. Selected cells may be punctured such that they collapse in the region to be disposed next to a sore area. The healthy region around the sore area absorbs any pressure, and pressure is relieved from the sore area. Methods of creating the sheet and methods of utilizing the sheet are also disclosed.

BRIEF DESCRIPTION OF THE DRAWINGS

The present invention will be described with reference to the accompanying drawings wherein.

DESCRIPTION OF A PREFERRED EMBODIMENT

Figure 1:
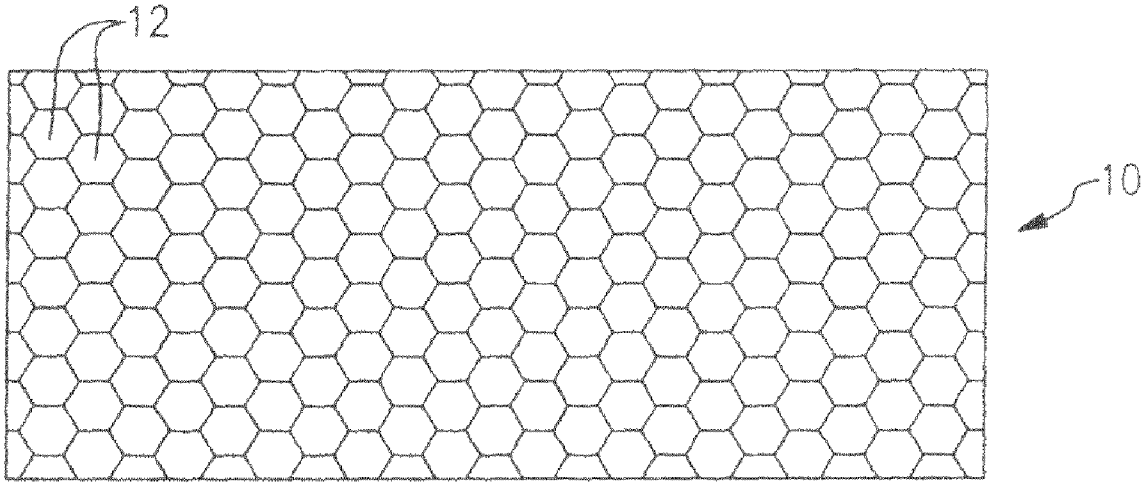
FIG. 1 is a top view illustration of a sheet of material in accordance with one embodiment of the present invention.

The present invention is described with reference to the accompanying drawings wherein like reference numerals refer to the same item.

There shown in FIG. 1 a sheet 10 in accordance with one embodiment of the present invention. The sheet 10 possesses an upper surface and a lower surface that is substantially parallel to the upper surface. As shown in FIG. 1, the sheet possesses a rectangular peripheral configuration, however, other peripheral configurations also may be utilized. For example, as will be appreciated better upon reading further herein, the peripheral configuration of sheet 10 may be selected to conform to the inside of various conventional sizes of shoes or other footwear.

Disposed within each sheet 10 are a plurality of closed cells 12. Each cell 12 preferably extends from near the lower surface to near the upper surface of the sheet 10. Each cell 12 may possess any of a number of different cross-sectional configurations, such as a circle, a square, a rectangle, or a triangle, or such as a hexagon, as shown in FIG. 1. As will be appreciated from reading further herein, preferred cross-sectional shapes allow the cells 12 to be packed or spaced relatively close together, with a minimum of material disposed therebetween. The cells 12 may be disposed in a uniform array or in an irregular array. Also, the cells 12 may possess the same or different cross-sectional configurations within the same sheet 10 and may possess the same or different cross-sectional sizes within the same sheet 10. Likewise, the spacing between the cells 12 may be varied, but preferably the distance between cells 12 is selected to be as little as possible while still retaining the advantageous strength and collapsibility characteristics of the sheet 10, as will be discussed further herein.

When taking a cross-section of the sheet 10 approximately mid-way between the upper surface and the lower surface thereof, the ratio of the area of material to the area within the cells is preferably about 0.1 to 0.5.

Each cell 12 preferably is completely filled with a flowable substance, such as a gas, a liquid, a gel, or a particulate solid. The gas, for example, may consist of air at an ambient pressure or at a relatively elevated pressure. The liquid, for example, may be water. The gel, for example, may be a petroleum jelly. And the particulate solid may, for example, be sand, saw dust, pellets of carbon, ground ceramic, or talcum powder. The flowable substance in the cells 12 of a sheet 10 may be the same throughout the sheet 10 or may be varied within the sheet 10. Gas is the preferred flowable substance because it is relatively light-weight and because it does not require clean-up. The substance filling each cell 12 is preferably non-toxic and preferably possesses a relatively high viscosity, preferably at least 5,000 Pa·s, and even more preferably at least 250,000 Pa·s.

The material surrounding each cell 12 is preferably non-porous and essentially seals the substance within the cell 12, so that the substance cannot migrate from the cell 12. Also preferably, the material completely fills the region between the cells 12. The material is characterized preferably as being substantially inelastic, and preferably as possessing low extensibility, high tensile strength, and some flexibility. The material may comprise a plastic.

The preferred characteristics of material are such that when pressure is applied to either the upper surface or the lower surface of the sheet 10, the sheet 10 substantially resists being compressed so, for example, when a pressure of about 100 pounds per square inch is applied against the sheet 10, the cells 12 do not rupture and the distance between the upper surface and the lower surface contracts no more than about 15%, and more preferably, no more than about 10%. Nonetheless, the material preferably has some flexibility that permits the sheet 10 to be bent in order to be inserted into footwear and other ambulatory aids and to conform to the natural contour of a foot sole, a heel, or other body surface.

The thickness between the upper surface and the lower surface of the sheet 10 is preferably selected depending upon the type of footwear or any other ambulatory aid into which the sheet 10 is to be inserted, the body region where the sheet 10 is to be applied, and the type of sore-like condition that is being treated. In one embodiment, the thickness is about one-quarter to five-eighths inch.

The cross-sectional diameter, distance, or extent across each cell is also preferably selected depending upon the characteristics of the intended use of sheer 10. In one embodiment the preferred cross-sectional diameter or extent of each cell 12 is about one centimeter to two centimeters, and in another embodiment is preferably about two to three centimeters. The cross-sectional diameter or extent of the cells 12 in the sheet 10 may be the same throughout the sheet 10 or may be varied within the sheet 10.

A preferred manner of utilizing the sheet 10 in connection with making a shoe insert will now be described. This procedure is especially efficacious in making customized peripheral shapes and sizes. It should be understood, however, that the following example is not the only way in which the shoe insert can be made in accordance with the present invention, and that inserts for other ambulatory aids, and the use of the sheet 10 without any footwear or ambulatory aids, is also contemplated within the scope of the present invention.

Presume, for example, that a patient has an ulcer on the ball of his tight foot and on the heel of his right foot. A health care practitioner may apply ink, colored oil, colored wax, or some other transferable marking substance on the ulcerated areas of the foot. Preferably, such marking material is not placed directly on the ulcerated areas, but placed so as to encircle or encompass the ulcerated areas.

Figure 2:
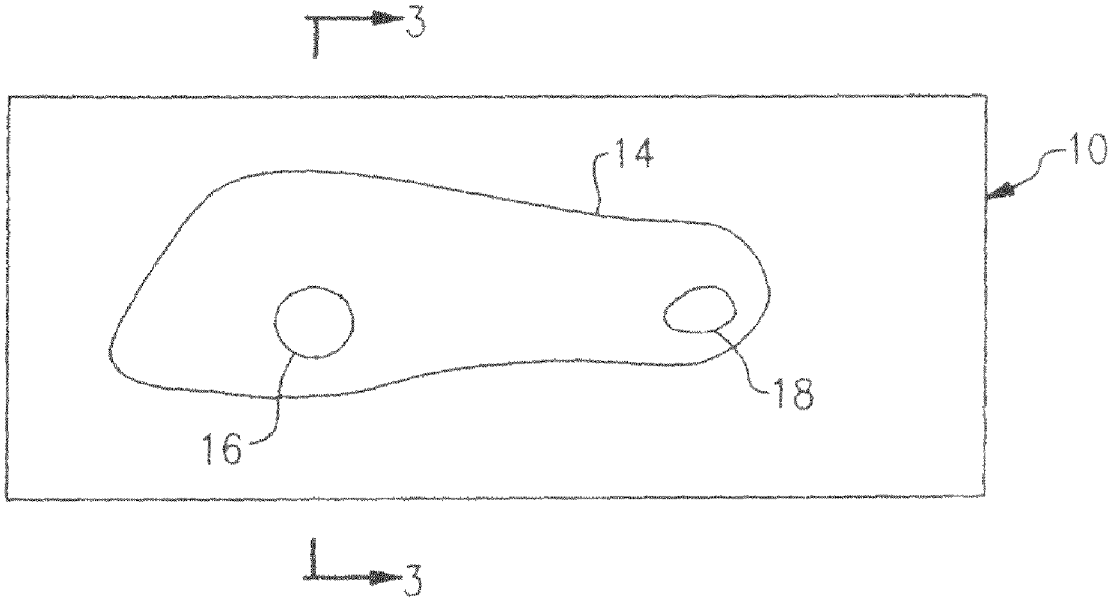
FIG. 2 is a top view of the sheet of material shown in FIG. 1 bearing an outline of a right sole of a human foot and two generally circular markings indicating the areas of sore conditions on the sole of that foot.

The patient then places his right foot centrally over the sheet 10 and stands so that his right foot bears upon the sheet 10. The health care practitioner then traces with a pen or other marking material an outline of the patient's foot onto the surface of the sheet 10, thereby creating an outline 14 of the foot, as shown in FIG. 2. The patient then lifts his foot off the sheet 10 whereupon the practitioner will see that the marking material placed near the ulcerated regions has been transferred onto and is deposited on the top surface of die sheet 10, as indicated by the circles 16, 18, shown in FIG. 2. The health care practitioner then cuts the sheet with a knife, scissors, or other implement along the outline 14. The practitioner then takes a pin, scalpel, or other sharp instrument and punctures through the material and into the cells 12 located within the circled regions 16, 18, which causes the flowable substance within those punctured cells to flow out of the punctured cells 12 and to the outside of the sheet 10. If these substances are other than a gas, then the practitioner may swab, wipe, or otherwise clean the sheet 10 so that such substances are removed from the surface.

Figure 3:
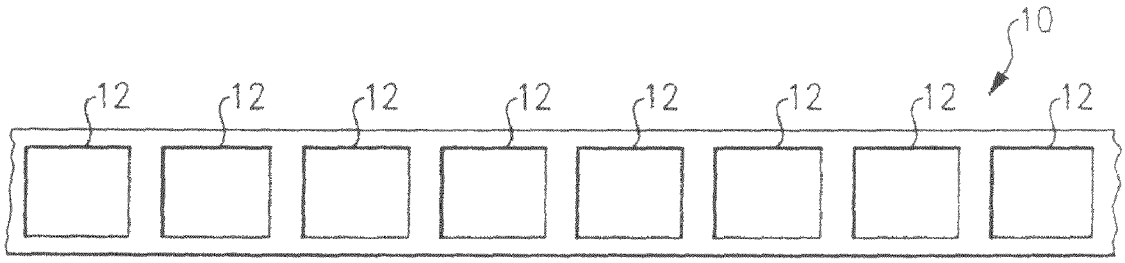
FIG. 3 is a cross-sectional schematic illustration of FIG. 2, taken along the lines 3-3.

FIG. 3 shows a schematical cross-sectional illustration of the sheet 10 including the array of cells 12 filled with the flowable substance. Again, the thickness of the sheet 10 in FIG. 3 will experience little contraction when a relatively large pressure or force is applied to a surface.

Figure 4:
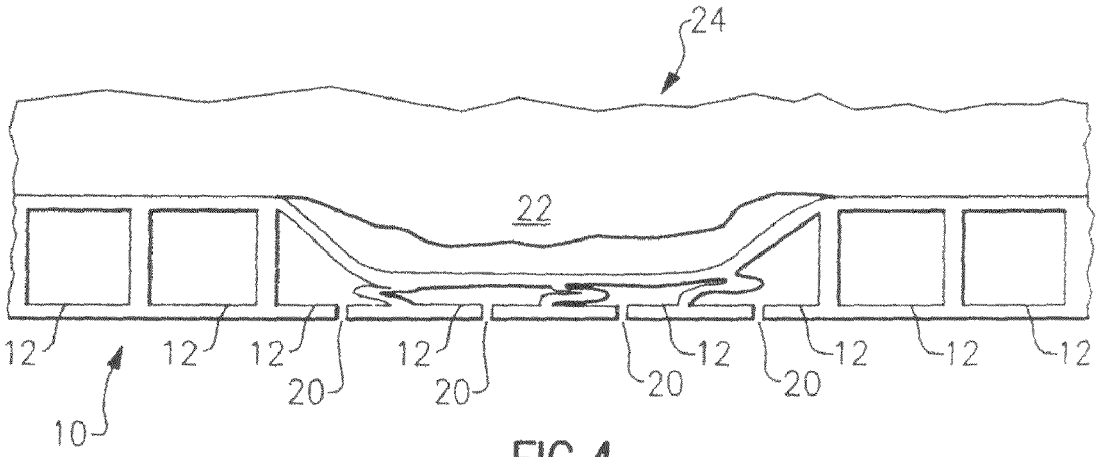
FIG. 4 is a cross-sectional schematic illustration as shown in FIG. 3 after four cells have been punctured and showing a human foot with an ulcer disposed on top of the sheet.

FIG. 4 depicts the same cross-sectional schematical illustration of the sheet 10 shown in FIG. 3 except that four adjacent cells 12 have been punctured through the lower surface thereof, as depicted by puncture holes 20. As the substance flows through the puncture holes 20, the walls between those punctured cells 12 and the surfaces above and beneath those punctured cells 12 will collapse, as shown in FIG. 4.

It will be appreciated that when the practitioner punctures the cells 12 of the cut-out of the sheet 10 within the various circled areas 16, 18, the punctured cells 12 will collapse, as shown in FIG. 4. The practitioner then may ask the patient to place his right foot on the cut-out after die selected cells 12 have been punctured to confirm that both the shape of the cut-out is appropriate and that the appropriate cells 12 have been punctured to relieve pressure in the ulcerated areas of the patient's right foot. The practitioner may thereafter make adjustments to the cur-out and may puncture more selected cells 12, until a proper fit is obtained. Finally, the practitioner may form a solid edge or border 28 as shown in FIG. 6B by applying heat along the peripheral edge of the cut-out if the material surrounding each 12 is meltable.

By referring to FIG. 4, it can be appreciated that an ulcerated area 22 of the patient's right foot 24 extends over and slightly into the collapsed region of the sheet 10, while importantly, the region of the foot 24 surrounding the ulcerated area 22 is firmly supported by a non-collapsed, substantially non-contracted portion of the sheet 10. As such, the sheet 10 provides firm support for the region of the foot 24 that is not ulcerated, while at the same time allowing the ulcerated area 22 to be relatively relieved of any pressure or forceful contact with the sheet 10. Although FIG. 4 depicts the ulcerated area 22 as floating above the top surface the sheet 10 in the collapsed region of the punctured cells 12, the invention contemplates that the ulcerated area 22 may contact the upper surface, albeit with substantially reduced pressure against the upper surface.

When the health care practitioner determines that the cut-out of the sheet 10 and the punctured cells 12 are properly selected, then the inner sole or a cut-out may be inserted into the patient's footwear to protect the affected areas. It should also be appreciated that the cut-out of the sheer 10 may be placed in a sock so that the patient's foot is covered with the sock, which may be inserted into the patient's shoe such that the cut-out is disposed adjacent to the patient's foot, and above a portion of the patient's sock, although such placement may be prone to slippage of the cut-out relative to the foot.

Either the upper surface or the lower surface, or both surfaces, of the sheet 10 may be provided with a slip resistance texture, such as a series of tiny ridges or hatchings, by embedding grains of sand or other particular material in the surface, through applying a light adhesive, or by other methods appreciated by those skilled in the art. The invention also contemplates that the upper surface or the lower surface, or both surfaces, of the sheet 10 may be coated or covered with lambskin or other material that may help absorb perspiration or that may provide a more comfortable feel against the person's skin after the cells 12 are punctured to create a collapsed region or pocket. Moreover, the material surrounding each cell 12 may be impregnated with carbon or another substance that reduces odor.

As previously mentioned, the sheet 10 may be selected to conform to the inside of various conventional sizes of shoes or other footwear. Such footwear includes, but it not limited to, surgical shoes and sandals, custom-molded shoes, and custom braces. For example, the sheet 10 may be in the peripheral shape of either an inner sole for a standard shoe size such as 7B or 9AA or an inner sole for certain types of surgical shoes or sandals. The sheet 10 may also possess a selected thickness, which may be selected depending on the use to which the sheet 10 is to be employed. For example, where the sheet 10 is to be employed in a confined space such as a shoe insert, then the sheet 10 may be relatively thin, such as, for example, about one to two centimeters. Where the sheet 10 is to be employed in a more open space, such as a surgical sandal, then the sheet 10 may be relatively thick, such as, for example, about two to three centimeters. Further, the thickness of the sheet 10 can be varied in accordance with the type of sore-like condition to be treated or the particular area of the skin to be protected. For example, if the sheet 10 is to be employed for an ulcer on the bottom of a heel, the sheet 10 could be made thicker in the region of the sheet 10 adapted to be disposed in the heel region of a shoe.

Figure 6A:
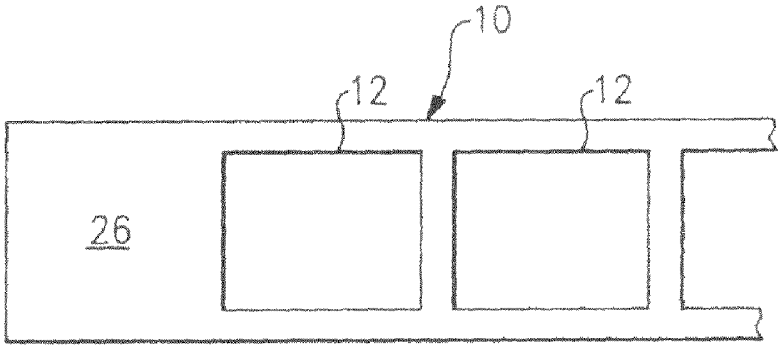
FIGS. 6A and 6B show cross-sectional schematic illustrations of different embodiments the sheet of material shown in FIG. 3 near a peripheral edge of the sheet.
Figure 6B:
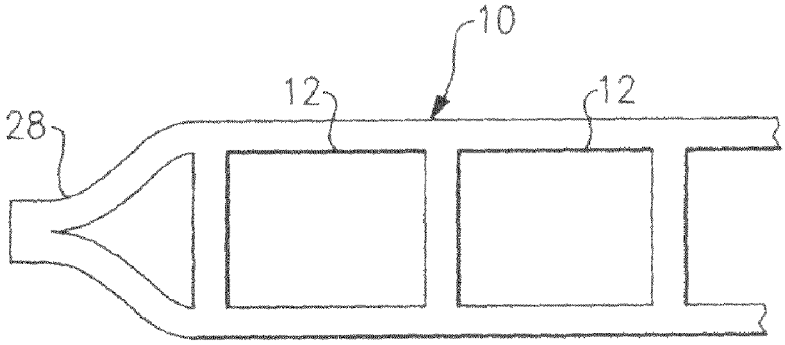

As shown in FIG. 6A, where the sheet 10 is pre-configured in a selected peripheral shape, the peripheral edge or border 26 may be of a solid material, without any cell 12. Such a construction helps to maintain support in the border area, since otherwise the border might include many collapsed cells 12, and also helps to retain the sheet 10 in a selected position during use.

As shown in FIG. 6B, a peripheral edge or border 28 of a sheet 10 may formed by merging or integrating the outer peripheral walls of a collapsed cell 12. Such merger or integration may be accomplished, for example, by having the material surrounding each cell 12 comprise a meltable plastic, then heating the peripheral edge or border 28 so as to cause to collapsed walls of the cells 12 to melt together, and then allowing the edge or border 26 to cool and thereby re-solidify. The heating may be attained by a propane torch, a hot iron, or other means appreciated by those skilled in the art. Preferably the solid edge or border 26, 28 is no wider than or only slightly wider than the cross-sectional diameter or extent of a cell 12.

The invention contemplates that a sock-liner can be applied to the upper surface of the sheet 10, preferably above the region of collapsed cells 12 or the pocket has been formed. The sock-liner would help absorb perspiration, reduce slippage, and provide comfort. Preferably the sock-liner is affixed to the upper surface of the sheer 10 by means of an adhesive, and preferably the adhesive creates a light, non-permanent adhesion so that the sock-liner can be removed and replaced with a new sock-liner. As with the cut-outs of the sheet 10, the sock-liner may be pre-formed in selected peripheral sizes and shapes or may be cut by a health care practitioner in customized configurations.

It is also within the purview of the invention to utilize a sheet 10 in which a selected region of cells 12 has already been collapsed to form a pocket before delivery of the sheet 10 to a health care practitioner or to a patient. In this embodiment, the health care practitioner either may cut the sheet 10 so that the collapsed region corresponds with where the sore-like condition is located, may additionally puncture more cells 12 nearby the already collapsed region so as to broaden the region of collapsed cells 12, or both.

Figure 5:
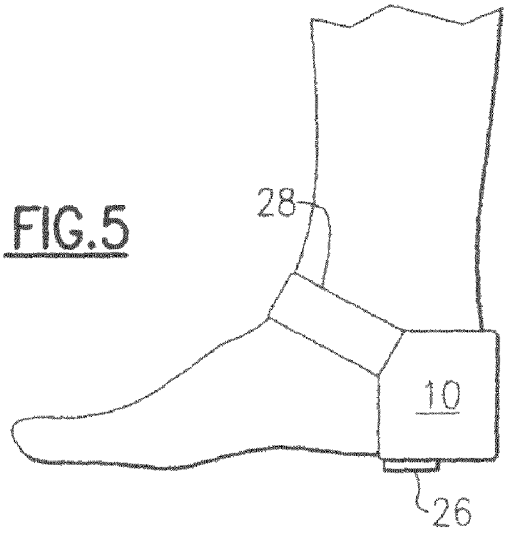
FIG. 5 is a side schematic illustration of another sheet in accordance with another embodiment of the present invention releasably secured to a human foot.

There is shown in FIG. 5 yet another embodiment of the present invention utilizing the sheet 10 of the previously described preferred embodiment. In the embodiment shown in FIG. 5, the sheet 10 is either initially formed or bent in a generally "U"-shape so that it is adapted to surroundly cup the rear bed portion of a person's foot. This embodiment of the present invention is especially useful for blisters and ulcers that form on a person's rear heel. The sheet 10 to be disposed adjacent to the blister or ulcer is punctured so that the cells 12 in that region collapse. The sheer 10 is provided with a pair of straps 26, 28 utilizing hook and loop fasteners, also known under the brand name "Velcro", so that the sheet 10 may be securely, releasably fastened to the person's heel. One of the straps 26 is disposed beneath the patient's heel, and the other strap 28 is disposed around the ankle and the front of the foot. Alternatively, the straps may be fastened to buckles, or may comprise laces. Further alternatively, the sheet 10 may be selectively secured to the ankle by a light adhesive, such as those commonly used with bandages. It is envisioned that the embodiment shown in FIG. 5 may be fashioned in a single commercial size, i.e. one-size-fits-all, or in a few discrete sizes, such as small, medium, and large. It is also contemplated that the configuration of the sheet 10 in the embodiment shown in FIG. 5 may be custom sized using a cut our technique such as that previously described.

The present invention also contemplates a method of constructing a sheet 10 such as that shown in FIG. 1 and FIG. 3. First, a mold is designed to create a wall along one surface of the sheet integral with interior walls that define and surround each cell 12. The mold may be in a form of basin possessing a relatively flat bottom and a plurality of protuberances disposed on and extending up from the bottom of the basin. The protuberances will form the cells 12, and thus, possess a configuration, spacing, etc. that corresponds with the desired configuration, spacing, etc. of the cells 12.

The mold is then filled with a curable material in liquid form such that the upper surface of the liquid extends above the plurality of protuberances a distance equal to the desired thickness of the wall forming the associated surface of the sheet 10. The material is then cured in the mold to form a solid blank and then the blank is removed from the mold.

The blank is then flipped so that the walls between the cells 12 extend upwardly, and then a substance such as water, petroleum jelly, or sand is placed in the void regions between those walls, such that the void regions become completely filled. Alternatively the cells 12 may be filled simply with an ambient gas at an ambient or selected pressure. Thereafter, the same curable material is coated while in a liquid state over the filled void regions and the upstanding wall sections and is allowed to cure, thereby forming the wall along die other surface of sheet 10. During the curing process, the curable material in liquid form will bond to the already cured material forming the walls between the cells 12.

While various embodiments of the present invention have been described herein, it will be appreciated that the invention includes embodiments other than those specifically illustrated or described and that changes in the form and arrangement of parts and the specific manner of practicing the invention may be varied without departing from the nature or scope of the invention. Consequently, the invention may be practiced otherwise than is specifically described above.

I claim:

1. A sheet adapted for juxtaposition adjacent to a region of an animal for relieving pressure at a selected subregion of the animal, said sheet comprising:

a layer of substantially solid, non-porous, inelastic material containing a plurality of cells distributed in an array therein such that said material substantially completely fills the region between said cells within said layer; and a flowable substance different from said material and substantially filling each of said cells, wherein said material possesses a composition essentially completely impermeable to said substance and effectively seals said substance in each of said cells.

2. A sheet according to claim 1 wherein said substance is selected from the group consisting of a liquid, a gel, and a particulate solid.

3. A sheet according to claim 2 wherein said substance is non-toxic.

4. A sheet according to claim 1 wherein said substance consists essentially of air.

5. A sheet according to claim 1 wherein said substance consists essentially of a fluid possessing a viscosity of at least about 10,000 Pa·s.

6. A sheet according to claim 1 wherein said material is manually puncturable by a sharp object such that when said material is punctured from the outside of said layer through to a selected one or more of said cells, then the substance in said selected one or more cells may flow through the region of the puncture to the outside of said layer, thereby leaving a void in said selected one or more cells.

7. A sheet according to claim 1 wherein said layer possesses an upper surface and a lower surface substantially parallel to the upper surface and wherein the ratio of the area occupied by said material to the area occupied by said substance, when viewed in a cross-section substantially intermediate the upper surface and the lower surface of said layer, ranges from about 0.1 to 0.5.

8. A sheet according to claim 7 wherein the distance between the upper surface and the lower surface is in the range of about one-quarter to five-eighths inch.

9. A sheet according to claim 1 wherein each cell possesses a substantially uniform configuration, and wherein said material is sufficiently rigid to maintain a particular cell in a substantially non-deformable condition when said substance fills said particular cell and is sufficiently flexible to collapse in the region of said particular cell when said particular cell is substantially devoid of said substance.

10. A sheet according to claim 1 wherein each of said cells possesses a substantially hexagon cross-section.

11. A sheet according to claim 7 wherein said material is sufficiently strong such that when a pressure of about 100 pounds per square inch is applied against the upper surface, the layer of material essentially does not rupture and cause said substance to leak from any cell and such that the distance between the upper surface and the lower surface contracts no more than about fifteen percent.

12. A sheet according to claim 11 wherein said distance contracts no more than about ten percent.

13. A sheet according to claim 1 further comprising means for securing said layer to said region.

14. A sheet according to claim 13 wherein said securing means is selected from the group consisting of an adhesive, a lace, a strap and buckle, and a hook and loop fastener.

15. A sheet according to claim 1 wherein said layer includes an upper surface and a lower surface substantially parallel to the upper surface and wherein at least one of said surfaces is provided with means for resisting slippage.

16. An insole adapted to be replaceably inserted into footwear, said insole comprising:

a sheet adapted for juxtaposition adjacent to a region of an animal for relieving pressure at a selected subregion of the animal, said sheet possessing a peripheral configuration substantially conformly to the peripheral configuration of the sole of a human foot, said sheet comprising:

a layer of substantially solid, non-porous, inelastic material containing a plurality of cells distributed in an array therein such that said material substantially completely fills the region between said cells within said layer; and a flowable substance different from said material and substantially filling each of said cells, wherein said material possesses a composition essentially completely impermeable to said substance and effectively seals said substance in each of said cells.

17. A sheet adapted for juxtaposition adjacent to a region of an animal for relieving pressure at a selected subregion of the animal, said sheet comprising:

a layer of substantially solid, non-porous, inelastic material containing a plurality of at least eight cells distributed in an array therein, said layer including an upper surface continuously extending above said plurality of cells and forming an upper wall of each of said plurality of cells, a lower surface continuously extending beneath said plurality of cells and forming a lower wall of each of said plurality of cells, said upper surface and said lower surface each extending in a substantially parallel relationship, and an intermediate grid extending substantially perpendicularly between and formed integrally with said upper surface and said lower surface, essentially forming the lateral walls of contiguous cells in said plurality of cells, and substantially completely filling the region laterally between contiguous cells in said plurality of cells; and a flowable substance different from said material and substantially filling each of said plurality of cells, wherein said material possesses a composition essentially completely impermeable to said substance and effectively seals said substance in each of said plurality of cells.

18. A sheet according to claim 17 wherein the thickness of said layer is substantially within the range of about one to three centimeters.

19. A sheet according to claim 17 wherein said layer possesses a peripheral configuration substantially conforming to the peripheral configuration of the sole of a human foot and wherein said plurality of cells are substantially completely, uniformly distributed throughout said layer.

20. A sheet according to claim 17 wherein the maximum lateral extent of each cell in said plurality of cells is substantially within the range of about one to three centimeters.

21. A sheet according to claim 17 wherein the ratio of the area occupied by said material to the area occupied by said substance, when viewed in a cross-section substantially intermediate the upper surface and the lower surface of said layer, ranges from about 0.1 to 0.5.

22. A sheet according to claim 17 wherein each cell possesses a substantially uniform configuration, and wherein said material is sufficiently rigid to maintain a particular one of said plurality of cells in a substantially non-deformable condition when said substance fills said particular cell and is sufficiently flexible to collapse in the region of said particular cell when said particular cell is substantially devoid of said substance.

23. A sheet adapted for juxtaposition adjacent to a region of an animal for relieving pressure at a selected subregion of the animal, said sheet comprising:

a layer of substantially solid, non-porous, inelastic material containing a plurality of at least eight cells, each cell of said plurality of cells possessing a substantially uniform configuration, said plurality of cells distributed substantially uniformly in an array therein such that said material substantially completely fills the region between said cells within said layer, wherein said layer possesses an upper surface and a lower surface substantially parallel to the upper surface and wherein the ratio of the area occupied by said material to the area occupied by said substance, when viewed in a cross-section substantially intermediate the upper surface and the lower surface of said layer, ranges from about 0.1 to 0.5, wherein said material is sufficiently strong such that when a pressure of about 100 pounds per square inch is applied against the upper surface, the layer of material essentially does not rupture and cause said substance to leak from any cell and such that the distance between the upper surface and the lower surface contracts no more than about fifteen percent; and a flowable substance different from said material and substantially filling each of said cells, wherein said material possesses a composition essentially completely impermeable to said substance and effectively seals said substance in each of said cells, wherein said material is manually puncturable by a sharp object such that when said material is punctured from the outside of said layer through to a selected one or more of said cells, then the substance in said selected one or more cells may flow through the region of the puncture to the outside of said layer, thereby leaving a void in said selected one or more cells, wherein said material is sufficiently rigid to maintain a particular cell in a substantially non-deformable condition when said substance fills said particular cell and is sufficiently flexible to collapse in the region of said particular cell when said particular cell is substantially devoid of said substance.

* * * * *